US010570913B2

(12) United States Patent
Maloyan et al.

(10) Patent No.: US 10,570,913 B2
(45) Date of Patent: Feb. 25, 2020

(54) SYSTEMS AND METHODS FOR GENERATING CLEAN ENERGY THROUGH HYDRODYNAMIC CLOSED CYCLE

(71) Applicants: Zhora Hovsep Maloyan, Los Angeles, CA (US); Arman Zhora Maloyan, Los Angeles, CA (US)

(72) Inventors: Zhora Hovsep Maloyan, Los Angeles, CA (US); Arman Zhora Maloyan, Los Angeles, CA (US)

(73) Assignees: Zhora Hovsep Maloyan, Los Angeles, CA (US); Arman Zhora Maloyan, Los Angeles, CA (US); Ruzan Arman Maloyan, Los Angeles, CA (US); Zhora Arman Maloyan, Los Angeles, CA (US); Edgar Arman Maloyan, Los Angeles, CA (US); Varazdat Gevorg Yeghikyan, Los Angeles, CA (US)

( * ) Notice: Subject to any disclaimer, the term of this patent is extended or adjusted under 35 U.S.C. 154(b) by 15 days.

(21) Appl. No.: 16/057,399

(22) Filed: Aug. 7, 2018

(65) Prior Publication Data

US 2018/0347580 A1 Dec. 6, 2018

Related U.S. Application Data

(63) Continuation-in-part of application No. 15/668,398, filed on Aug. 3, 2017, now Pat. No. 10,072,668.

(Continued)

(51) Int. Cl.

*F03B 17/00* (2006.01)
*F04D 29/22* (2006.01)

(Continued)

(52) U.S. Cl.

CPC ..... *F04D 29/22* (2013.01); *F03B 17/005* (2013.01); *F04D 1/00* (2013.01); *F04D 13/021* (2013.01);

(Continued)

(58) Field of Classification Search

CPC ..... F04D 29/22; F04D 13/12; F04D 13/021; F04D 29/043; F04D 13/06; F04D 29/426;

(Continued)

(56) References Cited

U.S. PATENT DOCUMENTS 4,182,123 A * 1/1980 Ueda ..... F03B 13/086 137/123
4,288,985 A * 9/1981 Dyck ..... F03B 13/086 137/132

(Continued)

FOREIGN PATENT DOCUMENTS

AM 548 A2 3/1999
AM 761 A2 3/2000

(Continued)

OTHER PUBLICATIONS

Non-Final Office Action dated Nov. 24, 2017, for U.S. Appl. No. 15/668,398, filed Aug. 3, 2017, 15 pages.

(Continued)

*Primary Examiner* — Eldon T Brockman
(74) *Attorney, Agent, or Firm* — Morrison & Foerster LLP

(57) ABSTRACT

Systems for pumping water are described. The system can include a covered pool containing a first volume of water, an oared water pump with a plurality of radial oars, an upper reservoir configured in fluid communication with the covered pool, a lower reservoir and a hydroelectric system. The oared pump can pump water from the covered pool into the upper reservoir. The upper reservoir can be configured to (Continued)

communicate water to the lower reservoir through the hydroelectric system with the lower reservoir configured in fluid communication with the covered pool.

21 Claims, 7 Drawing Sheets

Related U.S. Application Data

(60) Provisional application No. 62/494,482, filed on Aug. 11, 2016.

(51) Int. Cl.

| | |
|---|---|
| ***F04D 1/00*** | (2006.01) |
| ***F04D 29/42*** | (2006.01) |
| ***F04D 13/06*** | (2006.01) |
| ***F04D 29/043*** | (2006.01) |
| ***F04D 13/02*** | (2006.01) |
| ***F04D 13/12*** | (2006.01) |

(52) U.S. Cl.
CPC ..... *F04D 13/06* (2013.01); *F04D 13/12* (2013.01); *F04D 29/043* (2013.01); *F04D 29/426* (2013.01)

(58) Field of Classification Search
CPC ..... F04D 1/00; F03B 17/005; F03B 13/06; F03B 13/10
See application file for complete search history.

(56) References Cited

U.S. PATENT DOCUMENTS

| | | | | |
|---|---|---|---|---|
| 4,364,228 | A * | 12/1982 | Eller | F03B 13/08 137/143 |
| 4,396,842 | A | 8/1983 | Jhun | |
| 4,629,904 | A | 12/1986 | Rojo, Jr. et al. | |
| 5,319,151 | A | 6/1994 | Shiba et al. | |
| 5,377,485 | A * | 1/1995 | Bellamy | F03B 13/00 290/42 |
| 5,471,008 | A | 11/1995 | Fujita et al. | |
| 5,947,678 | A | 9/1999 | Bergstein | |
| 6,087,578 | A | 7/2000 | Kay | |
| 6,103,964 | A | 8/2000 | Kay | |
| 6,121,532 | A | 9/2000 | Kay | |
| 6,230,140 | B1 | 5/2001 | Severson et al. | |
| 6,234,761 | B1 | 5/2001 | Kocsis et al. | |
| 6,267,551 | B1 | 7/2001 | Dentinger | |
| 8,371,826 | B1 | 2/2013 | Johnson et al. | |
| 8,698,333 | B2 | 4/2014 | Glasser et al. | |
| 9,303,512 | B2 | 4/2016 | Iijima | |
| 2006/0112815 | A1 | 6/2006 | Sant | |
| 2011/0293416 | A1 | 12/2011 | Rohden | |
| 2012/0031256 | A1 | 2/2012 | Tsuchiya et al. | |
| 2012/0125624 | A1 | 3/2012 | Dyer | |
| 2015/0322969 | A1 | 11/2015 | Tanaka et al. | |
| 2015/0354526 | A1 | 12/2015 | Cripps | |
| 2016/0084249 | A1 | 3/2016 | Muramatsu et al. | |
| 2016/0090984 | A1* | 3/2016 | Cass | F01C 21/0863 418/82 |
| 2017/0206876 | A1 | 7/2017 | Ohta | |
| 2017/0221464 | A1 | 8/2017 | Ohta et al. | |

FOREIGN PATENT DOCUMENTS

| | | | |
|---|---|---|---|
| AM | 1884 | A2 | 12/2006 |
| AR | M-1732 | A2 | 3/2006 |
| RU | 877125 | | 10/1981 |
| RU | 2131993 | C1 | 6/1999 |
| RU | 2215196 | C2 | 10/2003 |
| RU | 2376494 | C2 | 12/2009 |
| RU | 2488713 | C2 | 7/2013 |

OTHER PUBLICATIONS

Notice of Allowance dated May 16, 2018, for U.S. Appl. No. 15/668,398, filed Aug. 3, 2017, 5 pages.
STIC Search Report, USPTO, Generated Nov. 24, 2017.

* cited by examiner

SYSTEMS AND METHODS FOR GENERATING CLEAN ENERGY THROUGH HYDRODYNAMIC CLOSED CYCLE

CROSS-REFERENCE TO RELATED APPLICATIONS

This application is a Continuation-in-Part of U.S. patent application Ser. No. 15/668,398 (now U.S. Publication No. 2018-0045212), filed Aug. 3, 2017, which claims benefit of U.S. Provisional Patent Application No. 62/494,482, filed Aug. 11, 2016, the contents of which are hereby incorporated by reference in their entirety for all purposes.

FIELD OF THE DISCLOSURE

This relates generally to systems and methods for generating hydroelectric power.

BACKGROUND OF THE DISCLOSURE

The production of electric power enables countless aspects of modern society and global demand for electric power seems to increase every year. Consequently, any device that can generate electric power is potentially valuable as a means of meeting the growing global demand for electric power. Furthermore, devices for generating power without emitting substantial amounts of greenhouse gasses are especially valuable in light of the threat of climate change as a possible consequence of greenhouse gasses emitted by many current forms of producing electric power.

SUMMARY OF THE DISCLOSURE

Some embodiments described in this disclosure are directed to a hydroelectric station to generate electric power. Some embodiments described in this disclosure are directed to hydroelectric stations with at least one oared pump with a plurality of radial oars. In some embodiments, any two adjacent radial oars of the plurality of radial oars can substantially form an angle. Moreover, in some embodiments the plurality of radial oars can include fifteen oars; in other embodiments the plurality of radial oars can include twenty radial oars. Some embodiments can include a covered pool that contains a first volume of water, and the oared pump can pump a portion of the first volume of water out of the covered pool and into a reservoir. The reservoir can be configured in fluid communication with the covered pool. In some embodiments, the reservoir can be configured to allow a second volume of water to flow into the covered pool via a hydro turbine system. In some embodiments, the second volume of water flowing from the reservoir and to the hydro turbine system can cause the hydro turbine system to communicate electric power to the oared pump. The full descriptions of the embodiments are provided in the Drawings and the Detailed Description, and it is understood that the Summary provided above does not limit the scope of the disclosure in any way.

BRIEF DESCRIPTION OF THE DRAWINGS

For a better understanding of the various described embodiments, reference should be made to the Detailed Description below, in conjunction with the following drawings in which like reference numerals refer to corresponding parts throughout the figures.

DETAILED DESCRIPTION

Description Of Embodiments

The following description sets forth exemplary methods, parameters, and the like. It should be recognized, however, that such description is not intended as a limitation on the scope of the present disclosure but is instead provided as a description of exemplary embodiments.

The terminology used in the description of the various described embodiments herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
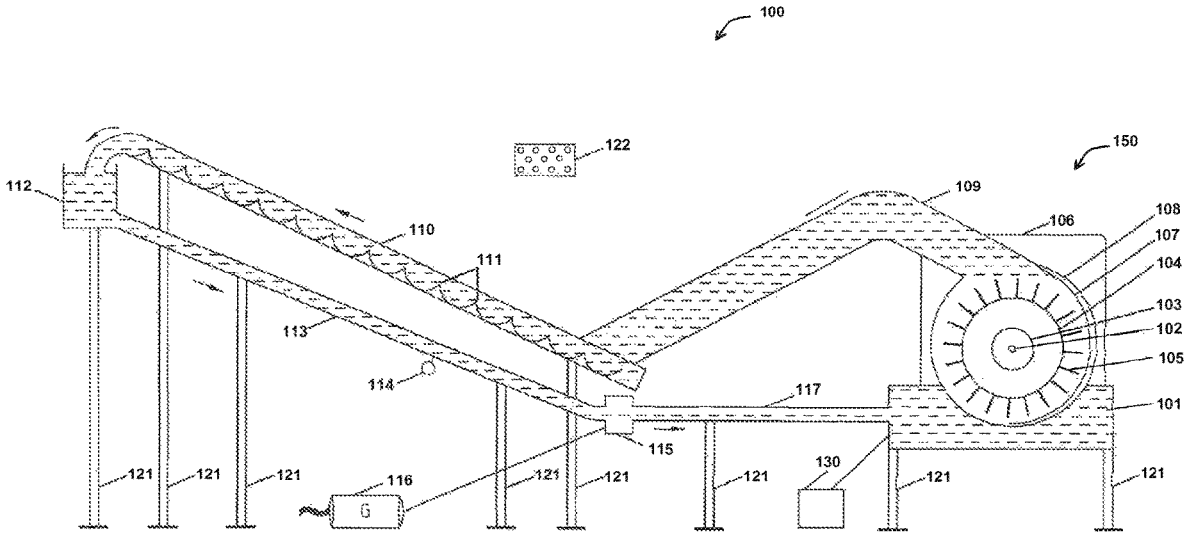
FIG. 1 illustrates a hydroelectric station in accordance with some embodiments.

FIG. 1 illustrates a hydroelectric station 100 in accordance with one embodiment. In some embodiments, the hydroelectric station 100 includes a covered pool 101 and an oared pump 150, which can further include a plurality of radial oars coupled to a cylindrical body 104, and a rotary 103 that is coupled to the cylindrical body 104 and to a shaft 102, to form a radial oar pump 150. Further, in some embodiments several of the components of the oared pump 150 (e.g., the plurality of radial oars 105, the cylindrical body 104, rotary 103 and shaft 102) are disposed at least partially within a roll-shaped cover 108. Furthermore, in some embodiments the roll-shaped cover 108 can be disposed within the pump cover 106. In some embodiments, the radial oars 105 can extend radially outward from the center of the cylindrical body 104, for example as shown in the embodiment of FIG. 1. In some embodiments, the oared pump 350 can be configured such that the cylindrical body 104 rotates at three thousand rotations per minute when the oared pump 150 operates. Alternatively, in other embodiments the oared pump 150 can be configured such that the cylindrical body rotates at two thousand rotations per minute when the oared pump 150 operates. As yet another example, in another embodiment the oared pump 150 may be configured such that the cylindrical body 104 rotates at one thousand rotations per minute when the oared pump 150 operates. As yet another example, in another embodiment the oared pump 150 may be configured such that the cylindrical body 104 rotates at five hundred rotations per minute when the oared pump 150 operates. As can be appreciated, in other embodiments of the system 100 the oared pump 150 can be configured such that the cylindrical body 104 rotates at any suitable number of rotations per minute when the oared pump 150 operates.

In many embodiments, the shaft 102 is coupled to one or more reducing gears that are in turn coupled to one or more electro motors, such that when the electro motor revolves at a specified number of revolutions per minute the reducer gear causes the shaft 102, and thereby the rotary 103 and the cylindrical body 104. The term reducer gear can refer to any suitable mechanism for converting the revolutions per minute of the shaft 102 to an appropriate number of revolutions per minute of the cylindrical body 104. As specific examples, a gearbox or transmission may be used to convert the revolutions per minute of the shaft 102 to another number of revolutions per minute of the cylindrical body 104. Thus, the reducer gear can be used to cause the cylindrical body 104 to revolve at a specified number of revolutions per minute that is some fraction (or multiple) of the revolutions per minute at which an electromotor revolves, the ratio of which is determined according to a reduction (or multiple) ratio (or a gear ratio) of the reducer gear.

For example, in one embodiment the reducer gear may have a reduction ratio of two to one and the electromotor may operate at ten rotations per minute and the reducer gear may cause the cylindrical body 104 to rotate at five rotations per minute. As another example, in another embodiment the reducer gear may have a reduction ratio of ten to one and the electromotor may operate at ten rotations per minute and the reducer gear may cause the cylindrical body to rotate at only one rotation per minute. As still another example, in one embodiment the reducer gear may have a reduction ratio of one hundred to one and the electromotor may operate at one thousand rotations per minute and the reducer gear may cause the cylindrical body 104 to rotate at ten rotations per minute. As yet another example, the reducer gear can be configured with a reduction ratio of ten and the at least one electromotor can input 30,000 rotations per minute into the reducer gear and the reducer gear may cause the cylindrical body 104 to rotate at 3,000 rotations per minute. As can be appreciated, however, the electromotor and reducer gear can be configured with any suitable rotations per minute (e.g., at the at least one electromotor and the cylindrical body 104) as required by the system 100.

In some embodiments the oared pump 150 can be configured such that when the system operates the shaft 102 is not substantially submerged in the water contained by the covered pool 101. In some embodiments, the oared pump 150 can include a plurality of radial oars 105 configured with a specific number of radial oars 105. For example, in some embodiments the plurality of radial oars 105 includes at least 10 radial oars coupled to the cylindrical body 104 of the oared pump 150. In other embodiments, the plurality of radial oars 105 includes at least 15 radial oars coupled to the cylindrical body 104 of the oared pump 150. In yet other embodiments, the plurality of radial oars 105 includes at least 18 radial oars coupled to the cylindrical body 104 of the oared pump 150. As can be appreciated, other embodiments of the oared pump 150 can include a plurality of radial oars 105 configured with any suitable number of radial oars.

In some embodiments of the system 100, each of the radial oars of the plurality 105 can also be disposed at a specific angle relative to each adjacent oar. For example, in some embodiments, each oar of the plurality of radial oars 105 can be separated from each other oar of the plurality of radial oars by a radial angle of twenty degrees. In other embodiments, each oar of the plurality of radial oars 105 can be separated from each other oar of the plurality of radial oars 105 by a radial angle of thirty degrees. As can be appreciated, the radial angle between any two adjacent radial oars of the plurality of radial oars 105 can be determined by the number of radial oars in the plurality 105 and can be configured to substantially form any angle suitable for the operation of the oared pump 150.

For example, the angle substantially formed by two adjacent radial oars of the plurality of radial oars 105 can be determined by the number of oars in the plurality of radial oars 105, the thickness of each radial oar of the plurality of radial oars 105, the size of the cylindrical body 104 of the oared pump 150, and the like. More specifically, the angle between any two adjacent radial oars of the plurality of radial oars 105 is not limited to angles between twenty and thirty degrees, and instead any two adjacent oars of the plurality of radial oars 105 can substantially form any angle that is suitable for the operation of the oared pump 150.

In some embodiments, the cylindrical body 104 and the plurality of radial oars 105 are configured such that the distance from the tip of the uppermost radial oar (as shown in FIG. 1) to the tip of the lowest radial oar is approximately 1 meter. In other embodiments, the distance from the tip of the uppermost radial oar to the tip of the lowest radial oar can be approximately half a meter. As can be appreciated, in other embodiments the distance from the tip of the uppermost radial oar to the tip of the lowest radial oar can be any suitable distance based on the configuration of the system 100 as a whole.

In some embodiments, a router 107 can be fixedly coupled to the pump cover 106. In some embodiments, the router 107 can be configured with a substantially round, semi-round, or substantially curved shape. More specifically, the router 107 can be configured (e.g., shaped) so that when the plurality of radial oars 105 are spinning (e.g., during operation of the oared pump 150) the plurality of radial oars 105 approach the router 107 without actually coming into physical contact with it. More specifically, when the oared pump 150 operates, each oar of the plurality of radial oars 105 spins and the edge of an oar that is opposite the cylindrical body 104 can approach the router 107, but the router may be configured with the appropriate curved or semi-round shape for the size of the cylindrical body and the length of each oar of the plurality of radial oars 105 so that none of the oars actually touches the router 107. In some embodiments, the router 107 is fixedly coupled with at least one side panel 108 which may reduce water loss or further facilitate the flow of water into the sloped crank pipe 109. In some embodiments, the upper end of the router 107 is fixedly coupled with sloped crank pipe 109, which, in certain embodiments, may have a square cross section. In some embodiments, the router 107 can be configured to direct water into the sloped crank pipe 109 when the oared pump 150 operates (i.e., when the cylindrical body 104 revolves in a counterclockwise direction).

In some embodiments, the sloped crank pipe 109 is in fluid communication with the sloped canal 110. Moreover, in some embodiments the sloped canal 110 can be configured with a waveform floor 111, for example as in the embodiment illustrated by FIG. 1. In some embodiments, sloped canal 110 can be sloped at an angle of 30-45 degrees from the horizontal. Waveform floor 111 can facilitate the pumping of water, by oared pump 150, up to reservoir 112, which can be at a relatively high altitude compared with oared pump 150 and covered pool 101. In some embodiments, the waveform floor 111 can be configured to allow the oared pump 150 to pump water up the sloped canal 110 with discrete increments of pressure at each portion of the sloped canal 110 and waveform floor 111. More specifically, in some embodiments the oared pump 150 can cause the water at a first portion of the waveform floor 111 to flow to the next portion of the waveform floor 111 when a discrete or specific pressure exists at that portion of the waveform floor 111. Furthermore, in some embodiments the pressure required to pump water from one portion of the waveform floor 111 to the next portion of the waveform floor 111 may be determined by the slope of the sloped canal 110 and the size, proportion, and material of the waveform floor 111. In some embodiments, the waveform floor 111 (or one or more surfaces thereof) may be composed of a plastic material (or a suitable polymer) configured to cause minimal friction with water flowing over the waveform floor 111. For example, in some embodiments the waveform floor 111 may be formed from thermoplastic shaped to form the waveform floor.

In some embodiments, the upper end of the sloped canal 110 may be in fluid communication with the reservoir 112, and through reservoir 112, the sloped canal 110 may also be in fluid communication with a turbine pipe 113, which can feed water down in altitude from reservoir 112 to hydro turbine system 115.

In some embodiments, the system 100 includes a hydro generator system 116 mechanically coupled to the hydro turbine system 115. In certain embodiments, water may circulate through the hydro turbine system 115 (e.g., water flowing down from reservoir through downpipe 113) and then into a water release pipe 117, which is in fluid communication with the covered pool 101. That is, in some embodiments gravity may cause the water to flow through the hydro turbine system 115, into the water release pipe 117 and finally flow into the covered pool 101. In some embodiments, therefore, the same water pumped out of the covered pool 101 by the oared pump 150 can flow into the covered pool 101 after flowing through the hydro turbine system 115 and the water release pipe 117. In some embodiments, the bottom of covered pool 101 can be sloped toward oared pump 150 (e.g., at 10, 15 or 30 degrees down, from left to right) to feed water from covered pool 101 to oared pump 150.

In some embodiments, the turbine pipe 113 is in fluid communication with the water release pipe 117 through the reservoir 112 and the hydro turbine system 115. In certain embodiments, the turbine pipe 113 can be removed from fluid communication with the hydro turbine system 115 via operation of a lock 114. In some embodiments, closing the lock 114 can close the sloped canal 110. For example, during operation of the system 100, the lock 114 can be closed and may prevent water from flowing out of the turbine pipe 113. In some embodiments, closing the lock 114 can also prevent water from flowing from the reservoir 112 and in turn removes the water upraise canal 110 from fluid communication with the rest of the system 100. As another example, in some embodiments the lock 114 can be configured to safely terminate the operation of the system 100 or to substantially terminate the flow of water within the system 100 when the lock 114 is engaged.

In some embodiments, the lock 114 is placed between the reservoir 112 and the generator system 115, such as in the embodiment illustrated in FIG. 1. As can be appreciated, however, in other embodiments the lock 114 can be placed in any suitable point within the system 100. In some embodiments, the lock 114 may be configured with electronic controls (e.g., at least one electronically controlled actuator) so that an automated management system (e.g., automated management system 122) can be configured to open and close the lock 114 to automatically control operation of the system 100. Thus, when the system is meant to idle or cease operation (e.g., to perform maintenance on the system 100) the lock 114 can be engaged (e.g., via electrical signal generated by automated management system 122) to cease operation of the system and substantially stop the water flow within the system 100.

In some embodiments, each of the components of the system 100 can be supported by a plurality of supports or base columns 121. As can be appreciated, the plurality of supports 121 can be configured to rigidly couple to each of the components of 100 in a manner than stabilizes and supports the system, such as during its operation. Moreover, in some embodiments one or more of the base columns of the plurality of supports 121 can be configured to physically couple with, or support, a body or housing that in turn couples with, or supports, the system 100.

In some embodiments, when installed on the plurality of supports or base columns 121, the system 100 can elevate water a substantial height, e.g., the reservoir 112 can be substantially higher than the covered pool 101. In some embodiments, the elevation between the covered pool 101 and the reservoir 112 may be between 10 meters and 300 meters. Alternatively, in some embodiments, the elevation between the covered pool 101 and the reservoir 112 may be between 150 and 200 meters. Alternatively, in some embodiments, the elevation between the covered pool 101 and the reservoir 112 may be between 10 and 100 meters. As can be appreciated, in other embodiments of the system 100 the elevation between the covered pool 101 and the reservoir 112 may be configured such that the elevation is any suitable height.

In some embodiments, the system 100 includes an automated management system 122 that can control the operation of the hydroelectric station 100, including the operation of the oared pump 150, operation of the lock 114, the operation of the hydro turbine system 115, and the operation of the hydro generator system 116. In some embodiments, the automated management system 122 can be configured to control each aspect of the operation of system 100, including the mechanical and electrical aspects of its operation such as closing or opening the lock 114 to allow the flow of water to the hydro turbine system 115 or to substantially stop the flow of water to the hydro turbine system 115 such as for performing maintenance on the system 100.

The automated management system 122 can include a processor that may execute instructions stored on a computer readable storage media that is configured in electrical communication with the processor. Moreover, in some embodiments the processor may include memory to help it execute the instructions stored on the computer readable storage media. For example, the automated management system 122 can be configured with a processor that executes a program from a computer readable storage media to automatically maintain a specified water pressure within the system 100. More specifically, the automated management system 122 can increase (or decrease) water pressure within the system 100 using the processor to generate signals that increase (or decrease) the revolutions per minute of the oared pump 150 in response to water pressure data collected from pressure sensors within the system 100 (e.g., in the sloped canal 110) and the instructions stored in the computer readable storage media.

In some embodiments, the cylindrical body 104 of oared pump 150 can revolve, rotate or spin and may thereby cause the plurality of radial oars 105 to likewise revolve. Moreover, the plurality of radial oars 105 may cause a portion of the water contained in the covered pool 101 to flow into the sloped crank pipe 109. In certain embodiments, the semi-round router may direct or otherwise facilitate the flow of water from the covered pool 101 and into the sloped crank pipe 109. In some embodiments, the oared pump 150 can be configured to cause the portion of water that flows from the covered pool 101 to flow into the sloped crank pipe 109 at a substantially high rate of flow and/or at substantial pressure. In some embodiments, the rate of flow can be between 2,000 and 3,000 cubic meters per second. In some embodiments, the rate of flow can be between 2,200 and 2,400 cubic meters per second. In some embodiments, the system optionally includes a water temperature control system 130 that maintains water in the system between two and six degrees Celsius. In a preferred embodiment, the water temperature control system maintains water in the system between three and five degrees Celsius. In some embodiments, the water temperature control system 130 may include a heater and/or a refrigerator. In some embodiments, the water temperature control system 130 may include antifreeze. In some embodiments, the water in the system has a density of over 998 kilograms per cubic meter. In some embodiments, the water in the system has a density of over 999 kilograms per cubic meter.

In some embodiments, water can flow from the sloped crank pipe 109 and into the sloped canal 110 and may ultimately flow into the reservoir 112. Moreover, in some embodiments, gravity may cause the water in the reservoir 112 to flow through turbine pipe 113 and operate hydro turbine system 115, which can be connected with hydro generator system 116. Alternatively or in addition, a water pressure in the reservoir 112 may cause water to flow from the reservoir 112 through the turbine pipe 113 and ultimately through the hydro turbine system 115. Thus, in some embodiments, the water flowing through turbine pipe 113 can also flow through turbine system 115 and thereby cause the hydro generator system 116 to operate and produce electrical power in response to the rotation of turbine system 115 caused by the flow of water through turbine system. Moreover, in some embodiments the shaft 102 is coupled to a reducer gear that is in turn coupled to an electromotor. In certain embodiments, the electromotor can be in electrical communication with the hydro generator system 116 (e.g., wires connecting the electromotor and the hydro generator system 116 such that power can flow between each), such that power generated by hydro generator system 116 can also be used to (at least partially) power oared pump 150.

Figure 2:
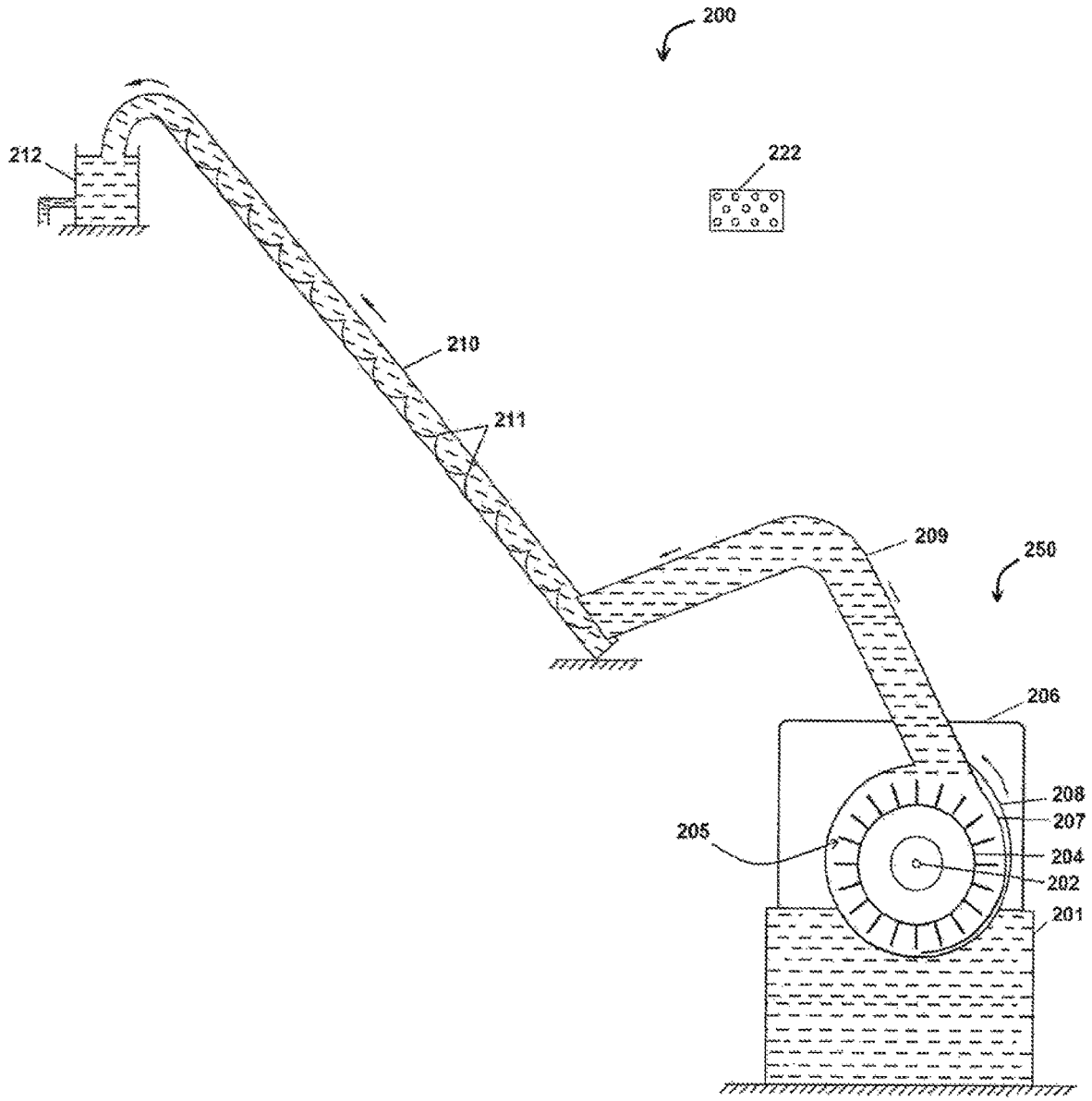
FIG. 2 illustrates a water pumping set in accordance with some embodiments.

FIG. 2 illustrates a water pumping set 200 in accordance with some embodiments. Water pumping set 200 can correspond to the appropriate portion of hydroelectric station 100 described above (e.g., oared pump 150, pipes/canals 109 and 110, and reservoir 112). The water pumping set 200 can include an oared pump 250 to pump water from a covered pool 201 up a sloped crank pipe 209 and a sloped canal 210 to ultimately collect in a reservoir 212. In some embodiments, the reservoir 212 is in fluid communication with the covered pool 201 via the sloped crank pipe 209 and the sloped canal 210.

Some embodiments of the oared pump 250 can include a plurality of radial oars 205 rigidly coupled to a cylindrical body 204 that is configured to rotate when the oared pump 250 operates. The cylindrical body 205 can be coupled to a shaft 202 that is in turn coupled to an electromotor or other means of rotating the cylindrical body 204 by rotating the shaft 202. In some embodiments, a router 207 can be fixedly coupled to a pump cover 206. In certain embodiments, the pump cover 206 can be configured to prevent water loss and retain water within the pumping set 200. Moreover, the router 207 can be configured with a round, semi-round, or curved shape in a similar manner to the description of the router 107 provided with reference to FIG. 1 above. Similarly, some embodiments of the router 207 may be fixedly coupled with at least one side panel 208. In some embodiments, the upper end of the router 207 is fixedly coupled with sloped crank pipe 209; the sloped crank pipe 209 having a square cross section in some embodiments. In certain embodiments, the router 207 can be configured to direct water into the sloped crank pipe 209 when the oared pump 250 operates (i.e., when the cylindrical body 204, and thus the plurality of radial oars 205, revolves in a counter-clockwise direction).

In some embodiments, the water pumping set 200 includes an automated management system 222 that can control the operation of the water pumping set 200, including the operation of the oared pump 250. In some embodiments, the automated management system 222 can be configured to control one or more aspects of the operation of the water pumping set 200, including any suitable mechanical and electrical aspects of its operation.

In some embodiments, the automated management system 222 can be configured to control the water pressure in the whole system 200, for example by controlling the amount of water pumped by the oared water pump 250. More specifically, in some embodiments the automated management system 222 can be configured to send at least one control signal to an electromotor of the oared pump 250 (e.g., electromotor 320 described with reference to FIG. 3A) to set the rotations per minute at which the electromotor will rotate the cylindrical body 204 of the oared pump 250.

In some embodiments the automated management system 222 may be configured to monitor the water pressure and/or water flow within the system 200 (e.g., via one or more sensors disposed in sloped crank pipe 209) and to automatically maintain a specific water pressure or rate of flow within the system 200. More specifically, the automated management system 200 may detect that the water pressure within the system 200 has fallen below a specified threshold pressure value and may automatically increase the rotations per minute of the water pump 250 (e.g., by sending one or more control signals directly to the electromotor or via an inverter of the oared pump 250) to increase the amount of water pressure within the system 200. Alternatively, or in addition, the automated management system 222 can be configured to automatically decrease the water pressure within the system 200 by decreasing the rotations per minute of the oared water pump 250 via one or more electronic control signals sent to the at least one electromotor of the oared pump 250 (e.g., the electromotor 320 described with reference to FIG. 3A).

Figure 3A:
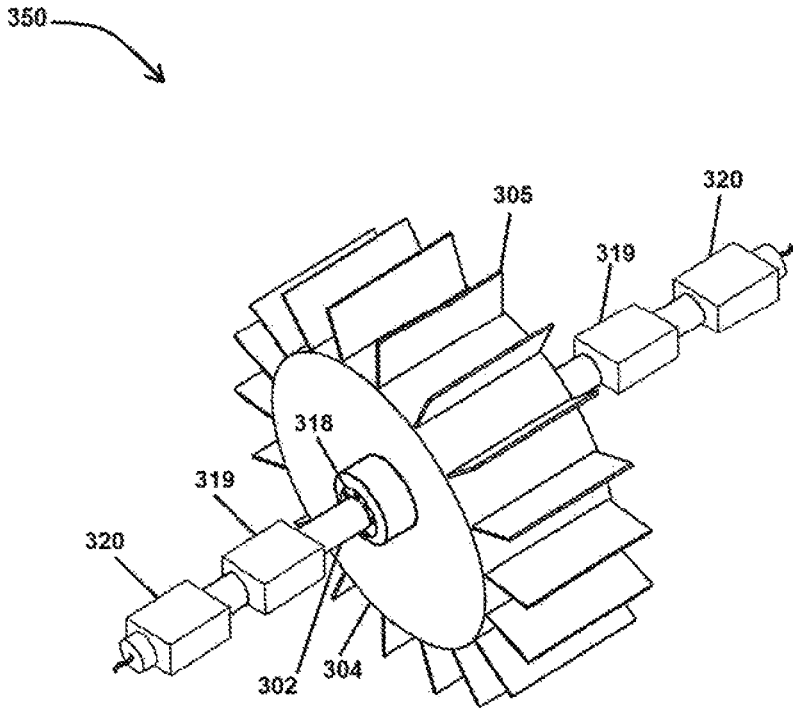
FIG. 3A illustrates a perspective view of an oared pump of a hydroelectric station in accordance with some embodiments.
Figure 3B:
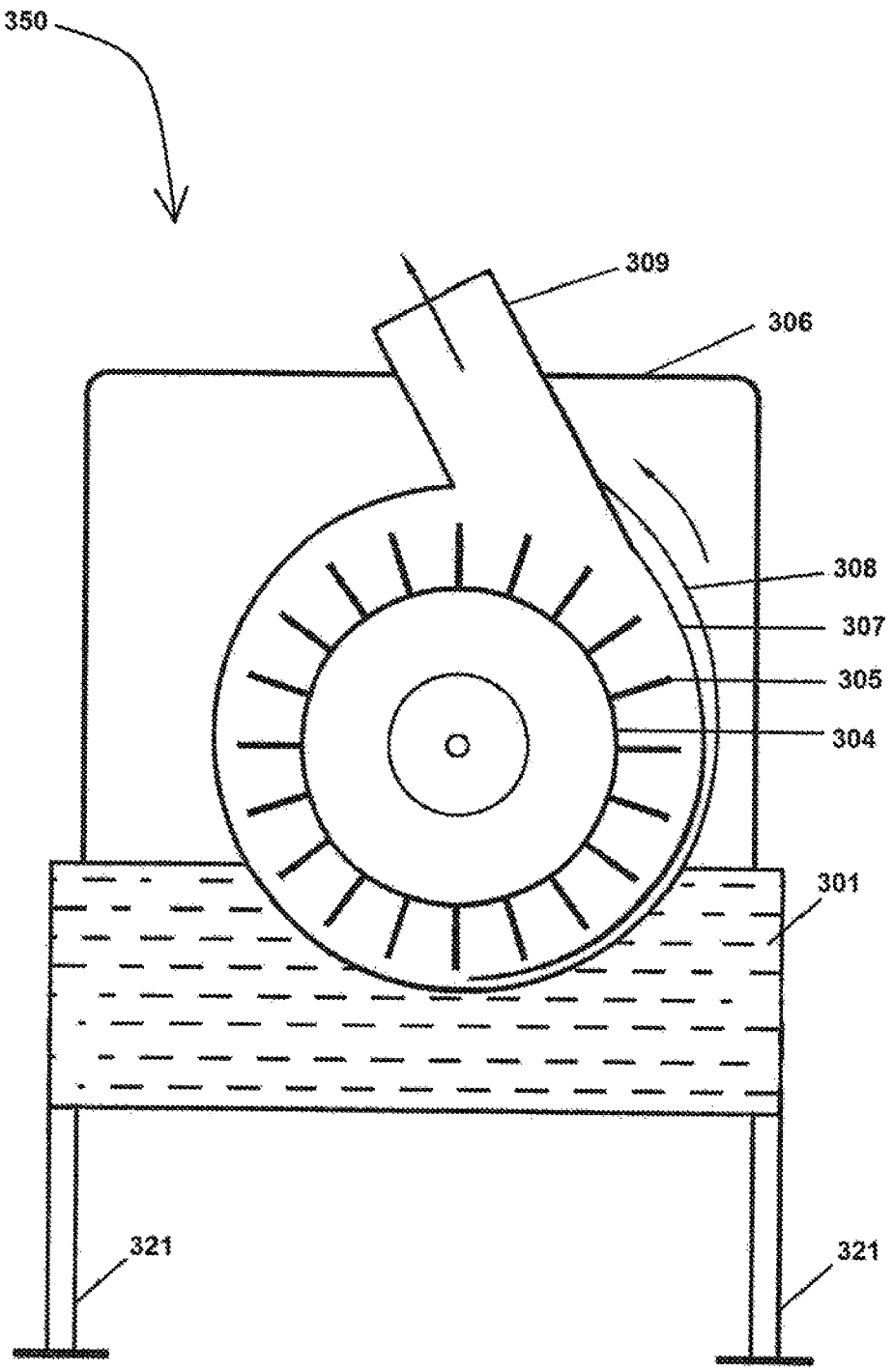
FIG. 3B illustrates a side view of an oared pump in accordance with some embodiments.
Figure 3C:
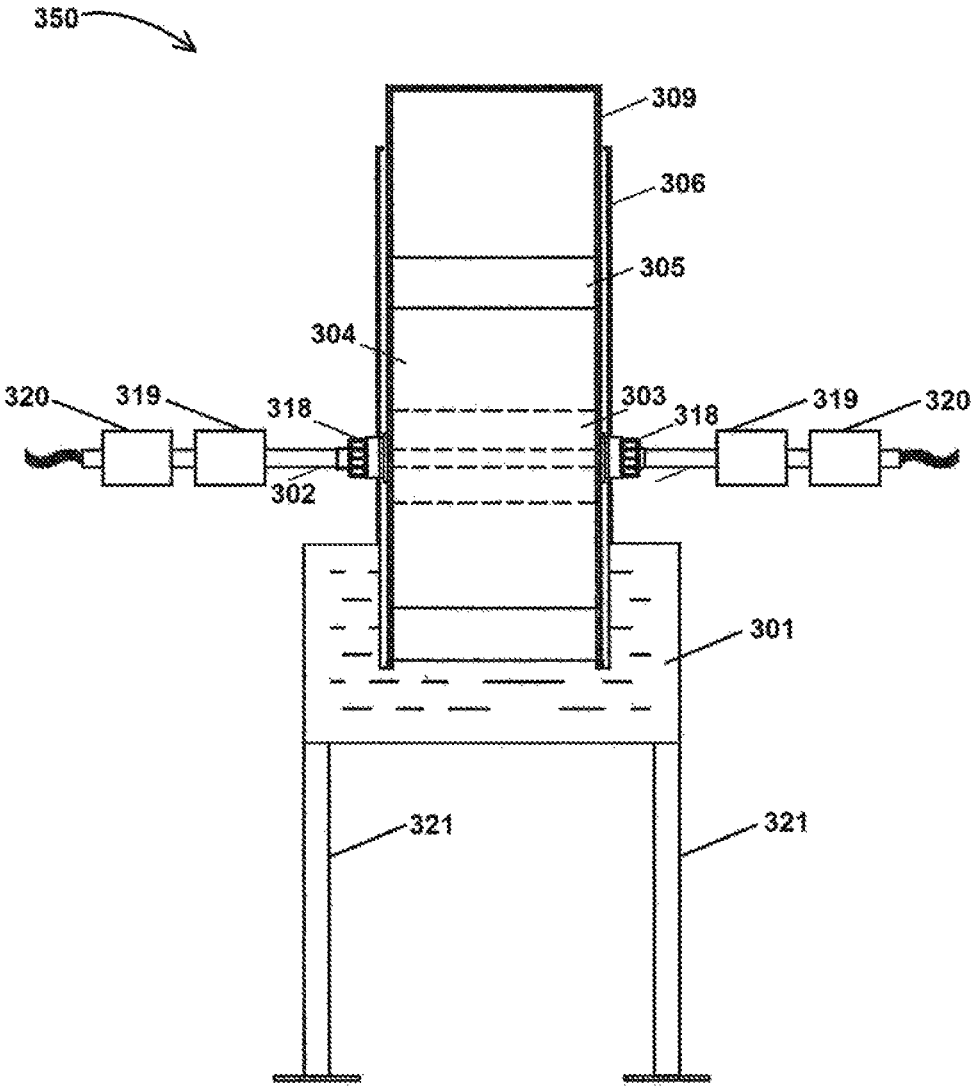
FIG. 3C illustrates a front view of an oared pump in accordance with some embodiments.

With reference to FIGS. 3A-3C collectively, an oared pump 350 is illustrated in three different perspectives, according to one embodiment. Oared pump 350 can correspond to oared pump 150 and/or 250. FIG. 3A illustrates a perspective view of an oared pump 350 of a hydroelectric station in accordance with some embodiments. FIG. 3B illustrates a side view of the oared pump 350 in accordance with the embodiment of FIG. 3A. FIG. 3C illustrates a front view of the oared pump 350 in accordance with the embodiment of FIG. 3A.

The proposed oared pump includes automated revolving part of the pump, which is made of a cylindrical rotary 302 coupled to a shaft 302, and a cylindrical body 304 that is in turn coupled to the cylindrical rotary 303. Furthermore, some embodiments may include a plurality of radial oars 305 that are fixedly coupled with the cylindrical body 304 of the oared pump. In certain embodiments, each oar of the plurality of radial oars 305 can be disposed along the cylindrical body 304 with an equal distance between any two oars of the plurality of radial oars 305.

In some embodiments, the oared pump 350 is operated with each end of the shaft 302 coupled to an electromotor 302 and reducer gears 319 (e.g., oared pump optionally includes two electro motors 302 and two reducer gears 319). In some embodiments, the reducer gears 319 and the electromotor 320 are coupled to opposite ends of a single shaft 302. Alternatively, in other embodiments the reducer gears 319 and the electro motors 320 can be coupled to different shafts 302 that may be independently controlled, such as by a magnetic clutch disposed within the cylindrical body 304, with an electromotor 320 that is in electrical communication with the hydro generator system (e.g., the hydro generator system 116 described with reference to FIG. 1); for example, the magnetic clutch can be used to selectively engage or disengage one side of the shaft 302 without engaging or disengaging the opposite side of the shaft 302.

In some embodiments, an automated management system (e.g., the automatic management systems 122 and 222 described with reference to FIGS. 1 and 2) can automatically control the magnetic clutch (i.e., alternate which symmetric side or half of the shaft 302 is coupled to the cylindrical body 304) such as by engaging and/or disengaging the magnetic clutch on one side of the shaft 302. Thus, in some embodiments, in a first phase of operation, oared pump 350 can be rotated via an electromotor 320 on one side while the electro motor 320 on the other side is disengaged from cylindrical body 304 via a magnetic clutch; in a second phase of operation, the opposite electro motor 320 and magnetic clutch can be engaged while the other electro motor 320 can be disengaged via its magnetic clutch. Such operation can prolong the life of electro motors 320. In some embodiments, the oared pump 350 further includes bearings 318 that are configured to facilitate operation of the oared pump 350. More specifically, the bearings 318 may allow the shaft 302 to couple with the cylindrical body 304 via the rotary 303.

In some embodiments, the shaft 302 may be separated into two halves that can engage and rotate the cylindrical body 304 independent on the other half of the shaft 304, and may be symmetric about the cylindrical body 304 of the oared pump 350. Specifically, in some embodiments one half of the shaft 302, electromotor 320, bearings 318, and reducer gear 319 on one side of the cylindrical body 304 mirror the configuration of the same components on the other side of the cylindrical body 304, but each symmetric half of the shaft 302 can be selectively engaged (coupled) with the cylindrical body 304 via a magnetic clutch. In some embodiments, therefore, the symmetric configuration of the shaft 302 and the related components (e.g., bearings 318, reducer gear 319, and electromotor 320) can allow the system to selectively alternate which of the two symmetric halves of the shaft 302 is coupled to, and thus used to rotate, the cylindrical body 304.

In some embodiments, the magnetic clutch (not shown) can be in electrical communication with an automated management system (e.g., automated management system 122 or 222 described with reference to FIGS. 1 and 2). More specifically, an automated management system may automatically engage and/or disengage the magnetic clutch on each half of the shaft 302. Embodiments that use a magnetic clutch to selectively engage different halves of the shaft 302 may substantially reduce the amount of maintenance required to operate the oared pump 350.

The cylindrical body 304, the plurality of radial oars 305, and at least a portion of the shaft 302 can each be disposed within a pump cover 306 (shown in FIGS. 3B and 3C). Moreover, in some embodiments a portion of the cylindrical body 304 and a portion of the plurality of radial oars 305 can be disposed within water contained by the pump cover 306 in a covered pool 301 (shown in FIGS. 3B and 3C). More specifically, in some embodiments only some of the plurality of radial oars 305 are disposed in the water of the covered pool 301 at any time. In some embodiments, therefore, there is a first portion of the plurality of radial oars 305 that is disposed in the water of the covered pool 301 and a second portion of the plurality of radial oars 305 that is not substantially in contact with the water of the covered pool 301.

For example, in one embodiment a first portion of the plurality of radial oars 305 disposed in the water of the covered pool 301 may include 7 radial oars (e.g., 6 compartments formed by the 7 radial oars), and the second portion of the plurality of radial oars 305 may include 13 radial oars that are not substantially in contact with the water of the covered pool 301. In some embodiments, 6 (e.g., 5 compartments formed by the 6 radial oars), 5 (e.g., 4 compartments formed by the 5 radial oars), or 4 (e.g., 3 compartments formed by the 4 radial oars) radial oars may be disposed in the water of the covered pool 301 at any moment in time.

In some embodiments, when the cylindrical body 304 and the plurality of radial oars 305 rotate the portion of the plurality of radial oars 305 that is disposed in the water of the covered pool 301 causes a portion of the water to flow up the sloped crank pipe 309.

In some embodiments, a router 307 can be fixedly coupled to the pump cover 306. More specifically, the router 307 can facilitate the operation of the oared pump 350 by substantially directing the flow of water into the sloped crank pipe 309 during operation of the pump 350. Moreover, the router 307 can be configured so that during operation of the oared pump 350 the plurality of radial oars 305 can approach the router 307 (e.g., as each oar of the plurality 305 spins the portion of the oar that is opposite the cylindrical body 305 can approach the router 307) without actually coming into physical contact with the router 307.

In some embodiments, the router 307 is fixedly coupled with at least one side panel 308 which may further facilitate the flow of water into the sloped crank pipe 309 during operation of the oared pump 350. In some embodiments, the upper end of the router 307 is fixedly coupled with sloped crank pipe 309. In some embodiments, the router 307 can be configured to direct water into the sloped crank pipe 309 when the oared pump 350 operates. More specifically, the router 307 can be configured so that when the cylindrical body 304 revolves in a counterclockwise direction the water pumped by the plurality of radial oars 305 flows into the sloped crank pipe 309.

As described above with reference to FIGS. 1 and 2, some embodiments of the oared pump 350 can include a plurality of radial oars 305 configured with a specific number of radial oars 305. For example, in some embodiments the plurality of radial oars includes at least 10 (or 10) radial oars coupled to the cylindrical body 304 of the oared pump 350. In other embodiments, the plurality of radial oars 305 includes at least 15 (or 15) radial oars coupled to the cylindrical body 304 of the oared pump 350. In other embodiments, the plurality of radial oars 305 includes at least 18 (or 18) radial oars coupled to the cylindrical body 304 of the oared pump 350.

Moreover and as also described with reference to the embodiments of FIGS. 1 and 2, each of the radial oars of the plurality 305 can also be disposed at a specific angle relative to each adjacent oar. For example, any two adjacent oars of the plurality of radial oars 305 can substantially form a radial angle that is approximately twenty degrees. In other embodiments, any two adjacent oars of the plurality of radial oars 305 can substantially form a radial angle of approximately thirty degrees. As can be appreciated, the angle created by any two adjacent radial oars of the plurality of radial oars 305 can be determined by the number of radial oars in the plurality 305 and can be configured to substantially form any angle suitable for the operation of the oared pump 350.

In some embodiments, the oared pump 350 can be supported by a plurality of supports or base columns 321. As can be appreciated, the plurality of supports 321 can be configured to rigidly couple to each of the components of the oared pump 350 in a manner than stabilizes and supports the pump 350, such as during its operation. In certain embodiments, the number and placement of the plurality of supports 321 can be determined based on the configuration of the oared pump 350 (e.g., size, RPM of the electromotor, number of oars in the plurality of radial oars 305, and the like). Moreover, in some embodiments one or more of the base columns of the plurality of base columns 321 can be configured to physically couple with, or support, a body or housing that in turn couples with, or supports, the oared pump 350. Alternatively or in addition, the supports 321 may include a body of the oared pump, or the pump cover 306, such that one or more components of the pump 350 (e.g., the sloped crank pipe 309) are formed by the support 321 while the supports 321 also facilitate overall operation of the oared pump 350 (e.g., reducing or substantially preventing unwanted shaking of the oared pump 350 during its operation).

Figure 4:
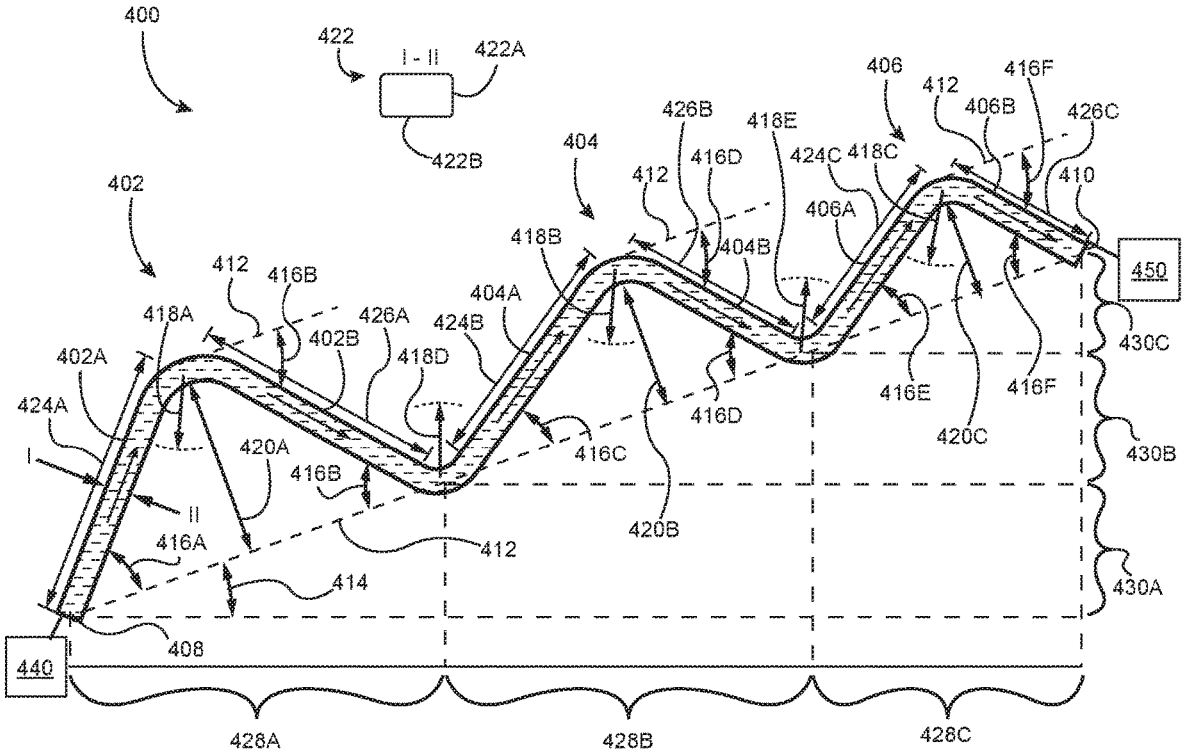
FIG. 4 illustrates a side view of a waveform water-transport channel in accordance with some embodiments.

FIG. 4 illustrates a waveform water-transport channel 400 in accordance with some embodiments. Waveform water-transport channel 400 can correspond to the appropriate portion of hydroelectric station 100 described above, e.g., sloped canal 110. In some embodiments, the waveform water-transport channel 400 transports water between the output port of a pump 440 (e.g., corresponding to oared pump 150 and sloped crank pipe 109 of hydroelectric station 100 described above) and a reservoir 450 (e.g., corresponding to reservoir 112 of hydroelectric station 100 described above). For example, in some embodiments, the incline portion of the sloped crank pipe 109 as shown in FIG. 1 will couple directly to the inlet port 408 of the waveform water-transport channel 400. In some embodiments, the overall path 412 of this transport will be at an incline, that is, the reservoir 450 will be installed higher than the pump 440, such that the water will need to move overall against the pull of gravity to get there. In some embodiments, the angle of incline of the overall path 412 (i.e., a direct path between the inlet port 408 and the outlet port 410) of the waveform water-transport channel 400 will form a reference plane situated at a reference angle 414 with respect to the horizontal plane 401, that is, a surface normal to the direction of the pull of gravity.

In some embodiments, the waveform water-transport channel 400 is divided into three sections, 402, 404, and 406. Each section contains both an incline portion (e.g., 402A, 404A, and 406A) and a decline portion (e.g., 402B, 404B, and 406B), creating a "waveform" path. For example, referring to section 402, the incline portion 402A rises for a distance 424A at an angle of rise 416A above the overall path 412, so that the angle of the incline portion with respect to the horizontal plane 401 is the sum of the angle of rise 416A and the reference angle 414. The decline portion 402B of section 402 falls for a distance 426A at an angle of fall 416B with respect to the overall path 412, to bring the channel 400 back to the overall path 412. The angle of decline of the decline portion 402B with respect to the horizontal plane 401 is the angle of fall 416B less the reference angle 414. The maximum separation between the channel section 402 and the overall path 412 is a height 420A. The incline portion 402A and decline portion 402B are smoothly connected such that the transition between the two is curved, creating a radius of curvature 418A. The decline portion 402B and the incline portion 404A of the adjacent section 404 are smoothly connected such that the transition between the two is curved, creating a radius of curvature 418D. Overall, section 402 of the water-transport channel 400 can transport water a distance 428A with respect to the horizontal plane 401 and can elevate water an elevation 430A. Section 404 and 406 are correspondingly dimensioned, with the dimensions in FIG. 4 labeled according to the same convention (e.g., angles 416C and 416D are the angles of rise and fall, respectively, of section 404).

In some embodiments, the reference angle 414 is between ten and thirty degrees. In some embodiments, the reference angle 414 is between fifteen and twenty-five degrees. In the preferred embodiment, the reference angle 414 is twenty degrees.

In a preferred embodiment, the three sections 402, 404, and 406 have certain relationships between their respective dimensions. In a preferred embodiment, section 402 has the highest rise away from the overall path 412, and section 406 has the lowest, such that height 420A is the tallest, height 420B the next tallest, and height 420C the shortest. In a preferred embodiment, the angles of rise are also related: the angle of rise 416A is the largest angle with respect to the overall path 412, while the angles of rise 416C and 416E are smaller. In some embodiments, the angle of rise 416A and angle of fall 416B of section 402 may be equal. In some embodiments, the angles of rise 416C and 416E may be equal. In some embodiments, the angles of fall 416D and 416F may be equal to angle of fall 416B of section 402. In a preferred embodiment, the radii of curvature 418A, 418B, and 418C are equal, and the radii of curvature 418D and 418E are equal. Additionally or alternatively, the radii of curvature 418A, 418B, and 418C are smaller than the radii of curvature 418D and 418E.

In some embodiments, the height 420A of the first section 402 can be between fifteen and twenty-five meters away from the overall path 412, the height 420B of the second section 404 can be between ten and twenty meters away from the overall path 412, and the height 420C of the third section 406 can be between ten and twenty meters away from the overall path 412. In some embodiments, the height 420A of the first section 402 can be between sixteen and twenty-one meters away from the overall path 412, the height 420B of the second section 404 can be between thirteen and eighteen meters away from the overall path 412, and the height 420C of the third section 406 can be between twelve and seventeen meters away from the overall path 412. In some embodiments, the ratio of heights 420A to 420B to 420C may be between ten to nine to nine and two to one to one. In some embodiments, the ratio of heights 420A to 420B to 420C may be between nine to eight to eight and three to two to two.

In some embodiments, the elevation 430A of the first section 402 can be between ten and twenty meters, the elevation 430B of the second section 404 can be between five and twenty meters, and the elevation 430C of the third section 404 can be between five and twenty meters. As can be appreciated, in other embodiments, the dimensions of sections 402, 404, and 406 can be changed to achieve any other suitable elevation. As can be appreciated, in other embodiments, the waveform water-transport channel 400 can include additional sections similar to 402, 404, or 406 such that the overall elevation 430 can be any suitable elevation.

In some embodiments, the angle of rise 416A is between thirty and fifty degrees and the angles of rise 416C and 416E are between twenty-five and forty-five degrees. In some embodiments, the angle of rise 416A is between forty-two and forty-seven degrees and the angles of rise 416C and 416E are between thirty and thirty-five degrees. In a preferred embodiment, the angle of rise 416A is forty-five degrees and the angles of rise 416C and 416E are thirty-two degrees. In some embodiments, the angles of fall 416B, 416D, 416F are between thirty and fifty degrees. In some embodiments, the angles of fall 416B, 416D, 416F are between forty-two and forty-seven degrees. In a preferred embodiment, the angles of fall 416B, 416D, and 416F are forty-five degrees. In a preferred embodiment, the ratio of angle of rise 416A to angle of rise 416C or angle of rise 416E is between five to four and four to three. In a preferred embodiment, the ratio of angle of fall 416B to angle of rise 416C is between five to four and four to three. In a preferred embodiment, the ratio of angle of fall 416D to angle of rise 416E is between five to four and four to three. In a preferred embodiment, the ratio of angle of fall 416F to angle of rise 416E is between five to four and four to three.

In some embodiments, the radii of curvature 418A, 418B, and 418C, are between one and five meters, and the radii of curvature 418D and 418E are between five and ten meters. In some embodiments, the radii of curvature 418A, 418B, and 418C, are between three and five meters, and the radii of curvature 418D and 418E are between six and eight meters. In a preferred embodiment, the radii of curvature 418A, 418B, and 418C are four meters, and the radii of curvature 418D and 418E are seven meters.

In some embodiments, the cross-section 422 of the water-transport channel 400 is rectangular, such that the dimension of the cross-section 422B parallel to the horizontal plane 401 is longer than or equal to the dimension of the cross-section 422A not parallel to the horizontal plane 401. In some embodiments, the dimension 422B is between seventy-five and 125 centimeters long, and the dimension 422A is between twenty-five and seventy-five centimeters long. In some embodiments, the dimension 422B is between ninety and 110 centimeters long, and the dimension 422A is between forty and sixty centimeters long. In a preferred embodiment, the dimension 422B is 100 centimeters long, and the dimension 422A is fifty centimeters long. In some embodiments, the waveform water-transport channel 400 is lined with a coating to reduce the friction of the interior, for instance, with a polytetrafluoroethylene (PTFE) coating such as Teflon. In some embodiments, the coating is substantially thin. In a preferred embodiment, the coating is one millimeter thick.

Figure 5:
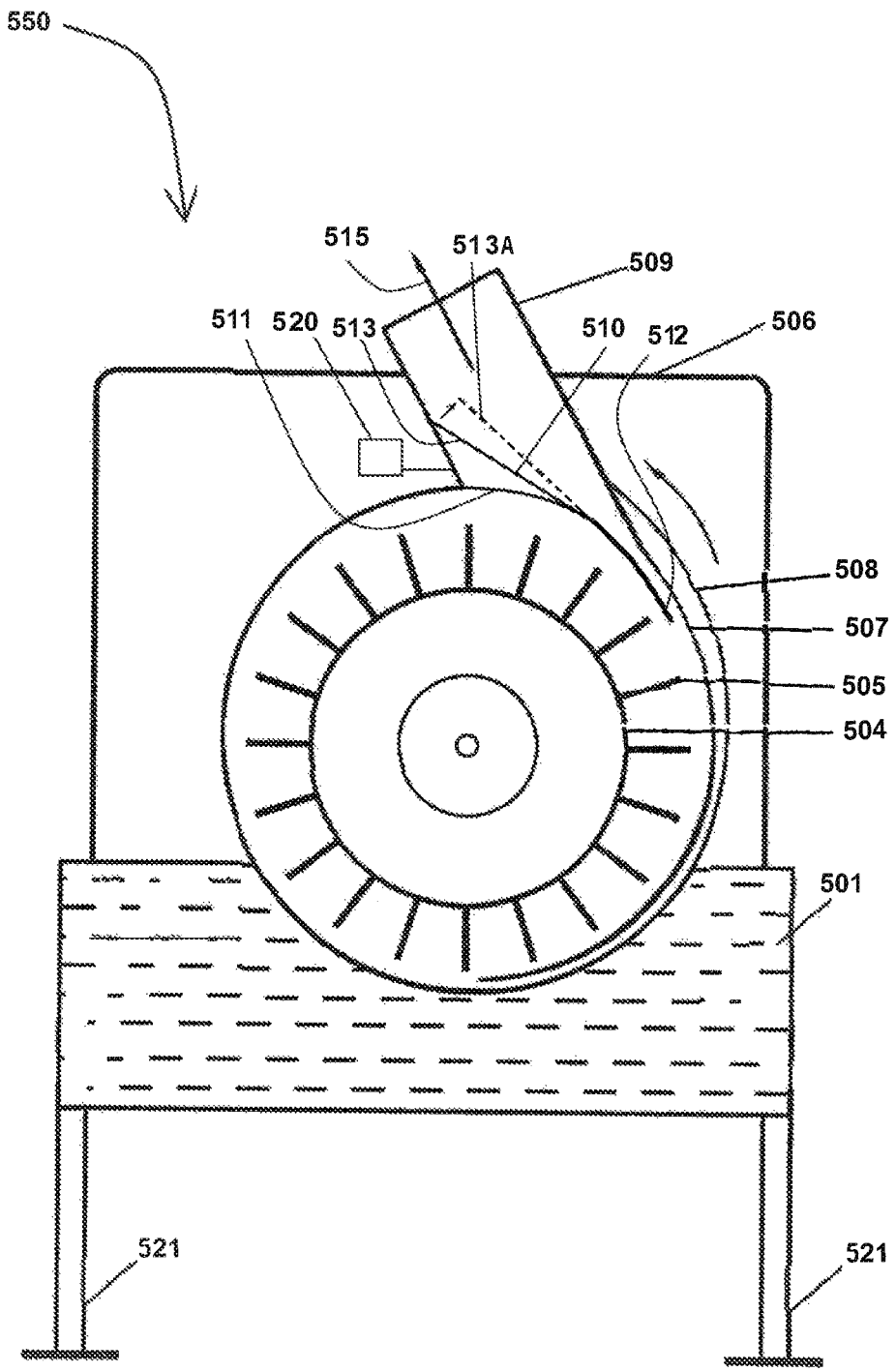
FIG. 5 illustrates a side view of an oared pump in accordance with some embodiments.

FIG. 5 illustrates a side view of an oared pump 550 in accordance with some alternative embodiments. In some embodiments, the oared pump includes a revolving cylindrical body 504, a plurality of radial oars 505 that are fixedly coupled with the cylindrical body 504, a pump cover 506, a side panel 508, a reservoir 501, and a first router 507, correspondingly similar to features described above with respect to FIG. 3C. Moreover, the oared pump includes an output port 509 and a second router 510.

The cylindrical body 504 and the plurality of radial oars 505 can each be disposed within a pump cover 506. Moreover, in some embodiments a portion of the cylindrical body 504 and a portion of the plurality of radial oars 505 can be disposed within water contained by the pump cover 506 in a reservoir 501. More specifically, in some embodiments only some of the plurality of radial oars 505 are disposed in the water of the reservoir 501 at any time. In some embodiments, therefore, there is a first portion of the plurality of radial oars 505 that is disposed in the water of the reservoir 501 and a second portion of the plurality of radial oars 505 that is not substantially in contact with the water of the reservoir 501.

In some embodiments, when the cylindrical body 504 and the plurality of radial oars 505 rotate the portion of the plurality of radial oars 505 that is disposed in the water of the reservoir 501 causes a portion of the water to flow up the output port 509.

In some embodiments, a first router 507 can be fixedly coupled to the pump cover 506 and with at least one side panel 508. More specifically, the first router 507 can facilitate the operation of the oared pump 550 by substantially directing the flow of water into the output port 509 during operation of the pump 550. Moreover, the first router 507 can be configured so that during operation of the oared pump 550 the plurality of radial oars 505 can approach the first router 507 (e.g., as each oar of the plurality 505 spins, the portion of the oar that is opposite the cylindrical body 505 can approach the first router 507) without actually coming into physical contact with the first router 507. In some embodiments, the upper end of the first router 507 is fixedly coupled with output port 509.

In some embodiments, a second router 510 can facilitate the operation of the oared pump 550 by substantially directing the flow of water into the output port 509 during operation of the pump 550. The second router 510 has three portions. A first portion 511 of the second router 510 can be fixedly coupled to at least one side panel 508 and located between the plurality of radial oars 505 and the output port 509. A second portion 512 of the second router 510 is coupled to the first portion 511 and located between the plurality of radial oars 505 and the first router 507 or output port 509. In some embodiments, the first portion 511 and second portion 512 extend such that they wrap around the cylindrical body and between two to six of the plurality of radial oars. A third portion 513 of the second router 510 is coupled to the second portion 512 and extends into the output port 509, between the first and second portions 511 and 512 and the path 515 through the output port 509. In other words, the flow of water ending in the path 515 begins in the covered pool 501, is pushed up between the first router 507 and the second portion 512 of the second router 510, and finally flows through the output port 509 between the third portion 513 of the second router 510 and the walls of the output port 509.

The first portion 511 and second portion 512, along with the first router 507 or side panel 508, form a passage through which water can be directed into the output port 509. The second router 510 can be configured so that during operation of the oared pump 550, the plurality of radial oars 505 can approach the second router 510 without actually coming into physical contact with the second router 510. In some embodiments, the second router 510 may be made of a relatively elastic material. In some embodiments, the second router 510 may be made of number 45 steel.

In some embodiments, one end of the third portion 513 of the second router 510 is fixedly coupled to the second portion 512 of the second router 510, but the other end is configured to move within the output port to restrict the flow of water through the output port 509. More specifically, the third portion 513 of the second router 510 may move towards the center of the output port 509, as shown in FIG. 5 by 513A. This movement reduces the size of the passage through the output port 509, increasing water pressure. Likewise, the third portion 513 may move back out towards the walls of the output port 509 to increase the size of the passage and decrease water pressure. In some embodiments, the third portion 513 may be moved inward during an initial phase of pump operation, to keep water pressure at a sufficient state before the pump reaches its full capacity.

In some embodiments, an actuator 520 is used to move the third portion 513 within the output port 509. For example, the third portion 513 may be moved using a piston or a rack and pinion. Alternatively, in some embodiments, the third portion 513 may itself be an actuator, for instance, the third portion 513 may be made of a shape-memory material (SMM). In some embodiments, the third portion 513 may be moved manually. Additionally or alternatively, the third portion 513 may be moved automatically (e.g., through the control of an automated management system 122, as described above).

Some examples of the disclosure are directed to a wave-form water-transport channel comprising: an inlet port 408 configured to couple to an output port of a pump; an outlet port 410 configured to be disposed higher than the inlet port such that a direct path 412 connecting the inlet port and outlet port and outlet port forms a reference plane with respect to a horizontal plane 401; and at least two channel sections, including: a first channel section 402 configured to transport water a first distance 428A with respect to the horizontal plane 401, wherein a maximum separation between the first channel section 402 and the reference plane is a first height 420A, an incline portion 402A of the first channel section is configured to rise at a first angle 416A with respect to the reference plane, and a decline portion 402B of the first channel section is configured to fall at a second angle 416B with respect to the reference plane; and a second channel section 404 configured to transport water a second distance 428B with respect to the horizontal plane 401, wherein a maximum separation between the second channel section 404 and the reference plane is a second height 420B, smaller than the first height, an incline portion 404A of the second channel section is configured to rise at a third angle 416C, smaller than the first angle 416A, with respect to the reference plane, and a decline portion 404B of the second channel section is configured to fall at a fourth angle 416D with respect to the reference plane.

Additionally or alternatively to the one or more examples provided above, in some examples, the second angle is equal to the first angle. Additionally or alternatively to the one or more examples provided above, in some examples, the fourth angle is equal to the first angle. Additionally or alternatively to the one or more examples provided above, in some examples, the first angle is between thirty and fifty degrees with respect to the reference plane. Additionally or alternatively to the one or more examples provided above, in some examples, a first transition section between the incline portion and the decline portion of the first channel section is curved and has a first radius of curvature, a second transition section between the decline portion of the first channel section and the incline portion of the second channel section is curved and has a second radius of curvature, and a third transition section between the incline portion and the decline portion of the second channel section is curved and has a third radius of curvature. Additionally or alternatively to the one or more examples provided above, in some examples, first and third radii of curvature are smaller than the second radius of curvature.

Additionally or alternatively to the one or more examples provided above, some examples further include a third channel section configured to transport water a third distance with respect to the horizontal plane, wherein a maximum separation between the third channel section and the reference plane is a third height, smaller than the second height, an incline portion of the third channel section is configured to rise at a fifth angle, smaller than the first angle, with respect to the reference plane, and a decline portion of the third channel section is configured to fall at a sixth angle with respect to the reference plane. Additionally or alternatively to the one or more examples provided above, in some examples, the second, fourth, and sixth angles are equal to the first angle, and the fifth angle is equal to the third angle. Additionally or alternatively to the one or more examples provided above, in some examples, the first angle is between thirty and fifty degrees with respect to the reference plane, and the third angle is between twenty-five and forty-five degrees with respect to the reference plane. Additionally or alternatively to the one or more examples provided above, in some examples, a first transition section between the incline portion and the decline portion of the first channel section is curved and has a first radius of curvature, a second transition section between the decline portion of the first channel section and the incline portion of the second channel section is curved and has a second radius of curvature, a third transition section between the incline portion and the decline portion of the second channel section is curved and has a third radius of curvature, a fourth transition section between the decline portion of the second channel section and the incline portion of the third channel section is curved and has a fourth radius of curvature, a fifth transition section between the incline portion and the decline portion of the third channel section is curved and has a fifth radius of curvature. Additionally or alternatively to the one or more examples provided above, in some examples, the first, third, and fifth radii of curvature are smaller than the second or fourth radii of curvature.

Additionally or alternatively to the one or more examples provided above, in some examples, a cross-section of the channel is a rectangle, a dimension of the cross-section parallel to the reference plane is longer than a dimension of the cross-section not parallel to the reference plane. Additionally or alternatively to the one or more examples provided above, in some examples, the first height of the first channel section is between sixteen and twenty-one meters, and the second height of the second channel section is between thirteen and eighteen meters. Additionally or alternatively to the one or more examples provided above, in some examples, the first height of the first channel section is between sixteen and twenty-one meters, and the second height of the second channel section is between thirteen and eighteen meters. Additionally or alternatively to the one or more examples provided above, in some examples, the first and third radii of curvature are between one and five meters, and the second radius of curvature is between five and ten meters. Additionally or alternatively to the one or more examples provided above, in some examples, an interior of the channel is coated with polytetrafluoroethylene (PTFE).

Some examples of the disclosure are directed to a system comprising: a first water reservoir containing a first volume of water; an oared pump with an output port, wherein the oared pump is partially submerged in the first volume of water and the output port is disposed at a top of the pump and wherein the oared pump comprises a cylindrical body and a plurality of radial oars fixedly coupled to the cylindrical body; an incline, waveform water-transport channel, wherein an inlet port of the incline channel is coupled to the output port of the oared pump and an outlet port of the incline channel is disposed higher than the inlet port; a second water reservoir coupled to the outlet port of the incline channel, and configured to contain a second volume of water; a decline water-transport channel, wherein an inlet port of the decline channel is coupled to the second water reservoir and an outlet port of the decline channel is coupled to an electromotor and to the first water reservoir; and the electromotor configured such that a rotor of the electromotor is caused to rotate by a flow of water through the decline channel.

Additionally or alternatively to the one or more examples provided above, some examples further comprise a first router that is shaped to facilitate the flow of water out of the first water reservoir and out of the output port of the oared pump when the cylindrical body rotates, the first router comprising a first portion disposed in the first volume of water and a second portion disposed outside of the first volume of water and wherein the first router does not come into physical contact with the plurality of radial oars. Additionally or alternatively to the one or more examples provided above, some examples further comprise a second router that is shaped to facilitate a flow of water out of the first water reservoir and out of the output port of the oared pump when the cylindrical body rotates, the second router comprising at least a first portion, a second portion, and a third portion, wherein: the first portion of the second router extends around a first number of the plurality of radial oars and is located between the first number of the plurality of radial oars and the third portion of the second router and between a first wall of the output port and the second portion of the second router; the second portion of the second router extends along a second number of the plurality radial oars and is located between the first router and the second number of the plurality of radial oars and adjacent to the first portion of the second router and the third portion of the second router; and the third portion of the second router extends into the output port, is located between the first wall and a second wall of the output port and adjacent to the second portion of the second router, and is configured to move within the output port in order to controllably restrict the flow of water as the flow of water moves through the output port; the second router does not come into physical contact with the plurality of radial oars; and a path of the flow of water is located between the plurality of radial oars and the first router, between the first router and the second portion of the second router, and between the third portion of the second router and the second wall of the output port.

Additionally or alternatively to the one or more examples provided above, in some examples the third portion of the second router is configured to move within the output port to restrict the flow of water through the output port during an initialization of the flow of water. Additionally or alternatively to the one or more examples provided above, some examples further comprise a water temperature control system that maintains water in the system between two and six degrees Celsius. Additionally or alternatively to the one or more examples provided above, in some examples a flow rate capacity through the incline channel is between 2,000 and 3,000 cubic meters per second.

Some examples of the disclosure are directed to an oared water pump comprising: a pump cover configured to form a covered pool with a first volume of water; a cylindrical body disposed substantially within the pump cover; and a plurality of radial oars fixedly coupled to the cylindrical body, wherein a first portion of the plurality of radial oars is configured to be disposed in the first volume of water and a second portion of the plurality of radial oars is configured to be disposed outside of the first volume of water. Additionally or alternatively to one or more examples disclosed above, in some examples, the plurality of oars comprises between 5 and 30 radial oars and wherein the first portion of the plurality of radial oars that is configured to be disposed in the first volume of water comprises between 2 and 20 radial oars. Additionally or alternatively to one or more examples disclosed above, in some examples, the plurality of oars comprises between 12 and 24 radial oars and wherein the first portion of the plurality of radial oars that is configured to be disposed in the first volume of water comprises between 3 and 16 radial oars. Additionally or alternatively to one or more examples disclosed above, in some examples, the plurality of oars comprises between 15 and 20 radial oars and wherein the first portion of the plurality of radial oars that is configured to be disposed in the first volume of water comprises between 4 and 8 radial oars. Additionally or alternatively to one or more examples disclosed above, in some examples, the plurality of oars comprises 18 radial oars and wherein the first portion of the plurality of radial oars that is configured to be disposed in the first volume of water comprises between 4 radial oars.

Additionally or alternatively to one or more examples disclosed above, in some examples, an oared water pump comprises a pump cover configured to form a covered pool with a first volume of water; a cylindrical body disposed substantially within the pump cover; a plurality of radial oars fixedly coupled to the cylindrical body; and a first electromotor coupled to a first reducer gear, wherein the first reducer gear is also coupled to a first shaft that is configured to couple to the cylindrical body, the first electromotor configured to cause the cylindrical body and the plurality of radial oars to rotate via the first reducer gear to pump a portion of the first volume of water out of the covered pool. Additionally or alternatively to one or more examples disclosed above, in some examples, the reducer gear of the oared pump is configured with a reduction ratio of two to one. Additionally or alternatively to one or more examples disclosed above, in some examples, the reducer gear of the oared pump is configured with a reduction ratio of ten to one. Additionally or alternatively to one or more examples disclosed above, in some examples, the reducer gear of the oared pump is configured with a reduction ratio of one hundred to one. Additionally or alternatively to one or more examples disclosed above, in some examples, the system further comprises a second electromotor coupled to a second reducer gear, wherein the second reducer gear is also coupled to a second shaft that is configured to couple to the cylindrical body, the second electromotor configured to cause the cylindrical body and the plurality of radial oars to rotate via the second reducer gear to pump a portion of the first volume of water out of the covered pool, and one or more magnetic clutches configured to selectively control the coupling of either of the first electromotor or the second electromotor with the cylindrical body.

Additionally or alternatively to one or more examples disclosed above, in some examples, an oared water pump comprises a pump cover configured to form a covered pool with a first volume of water; a cylindrical body disposed substantially within the pump cover; and a plurality of radial oars fixedly coupled to the cylindrical body with a radial angle between adjacent radial oars of the plurality of radial oars. Additionally or alternatively to one or more examples disclosed above, in some examples, the radial angle between adjacent radial oars of the plurality of radial oars is between 10 and 40 degrees. Additionally or alternatively to one or more examples disclosed above, in some examples, the radial angle between adjacent radial oars of the plurality of radial oars is between 15 and 35 degrees. Additionally or alternatively to one or more examples disclosed above, in some examples, the radial angle between adjacent radial oars of the plurality of radial oars is between 20 and 30 degrees. Additionally or alternatively to one or more examples disclosed above, in some examples, the radial angle between adjacent radial oars of the plurality of radial oars is 25 degrees.

Additionally or alternatively to one or more examples disclosed above, in some examples, an oared water pump may comprise a pump cover configured to form a covered pool with a first volume of water; a cylindrical body disposed substantially within the pump cover; and a plurality of radial oars fixedly coupled to the cylindrical body, wherein a first portion of the plurality of radial oars is configured to be disposed in the first volume of water and a second portion of the plurality of radial oars is configured to be disposed outside of the first volume of water. Additionally or alternatively to one or more examples disclosed above, in some examples, the plurality of oars comprises between 5 and 30 radial oars and wherein the first portion of the plurality of radial oars that is configured to be disposed in the first volume of water comprises between 2 and 20 radial oars. Additionally or alternatively to one or more examples disclosed above, in some examples, the plurality of oars comprises between 12 and 24 radial oars and wherein the first portion of the plurality of radial oars that is configured to be disposed in the first volume of water comprises between 3 and 16 radial oars. Additionally or alternatively to one or more examples disclosed above, in some examples, the plurality of oars comprises between 15 and 20 radial oars and wherein the first portion of the plurality of radial oars that is configured to be disposed in the first volume of water comprises between 4 and 8 radial oars. Additionally or alternatively to one or more examples disclosed above, in some examples, the plurality of oars comprises 18 radial oars and wherein the first portion of the plurality of radial oars that is configured to be disposed in the first volume of water comprises between 4 radial oars.

Additionally or alternatively to one or more examples disclosed above, in some examples, the oared water pump further comprises a first electromotor coupled to a first reducer gear, wherein the first reducer gear is also coupled to a first shaft that is configured to couple to the cylindrical body, the first electromotor configured to cause the cylindrical body and the plurality of radial oars to rotate via the first reducer gear to pump a portion of the first volume of water out of the covered pool. Additionally or alternatively to one or more examples disclosed above, in some examples, the reducer gear of the oared pump is configured with a reduction ratio of two to one. Additionally or alternatively to one or more examples disclosed above, in some examples, the reducer gear of the oared pump is configured with a reduction ratio of ten to one. Additionally or alternatively to one or more examples disclosed above, in some examples, the reducer gear of the oared pump is configured with a reduction ratio of one hundred to one. Additionally or alternatively to one or more examples disclosed above, in some examples, the oared water pump further comprises a second electromotor coupled to a second reducer gear, wherein the second reducer gear is also coupled to a second shaft that is configured to couple to the cylindrical body, the second electromotor configured to cause the cylindrical body and the plurality of radial oars to rotate via the second reducer gear to pump a portion of the first volume of water out of the covered pool, and one or more magnetic clutches configured to selectively control the coupling of either of the first electromotor or the second electromotor with the cylindrical body.

Additionally or alternatively to one or more examples disclosed above, in some examples, the plurality of radial oars are further configured with a radial angle between adjacent radials oars of the plurality of radial oars. Additionally or alternatively to one or more examples disclosed above, in some examples, the radial angle between adjacent radial oars of the plurality of radial oars is between 10 and 40 degrees. Additionally or alternatively to one or more examples disclosed above, in some examples, the radial angle between adjacent radial oars of the plurality of radial oars is between 15 and 35 degrees. Additionally or alternatively to one or more examples disclosed above, in some examples, the radial angle between adjacent radial oars of the plurality of radial oars is between 20 and 30 degrees. Additionally or alternatively to one or more examples disclosed above, in some examples, the radial angle between adjacent radial oars of the plurality of radial oars is 25 degrees.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best use the invention and various described embodiments with various modifications as are suited to the particular use contemplated.

The invention claimed is:

1. A waveform water-transport channel comprising:

an inlet port configured to couple to an output port of a pump;

an outlet port configured to be disposed higher than the inlet port such that a direct path connecting the inlet port and outlet port forms a reference plane with respect to a horizontal plane; and at least two channel sections, including:

a first channel section configured to transport water a first distance with respect to the horizontal plane, wherein a maximum separation between the first channel section and the reference plane is a first height, an incline portion of the first channel section is configured to rise at a first angle with respect to the reference plane, and a decline portion of the first channel section is configured to fall at a second angle with respect to the reference plane; and a second channel section configured to transport water a second distance with respect to the horizontal plane, wherein a maximum separation between the second channel section and the reference plane is a second height, smaller than the first height, an incline portion of the second channel section is configured to rise at a third angle, smaller than the first angle, with respect to the reference plane, and a decline portion of the second channel section is configured to fall at a fourth angle with respect to the reference plane.

2. The waveform water-transport channel of claim 1, wherein the second angle is equal to the first angle.

3. The waveform water-transport channel of claim 2, wherein the fourth angle is equal to the first angle.

4. The waveform water-transport channel of claim 3, wherein the first angle is between thirty and fifty degrees with respect to the reference plane.

5. The waveform water-transport channel of claim 1, wherein a first transition section between the incline portion and the decline portion of the first channel section is curved and has a first radius of curvature, a second transition section between the decline portion of the first channel section and the incline portion of the second channel section is curved and has a second radius of curvature, and a third transition section between the incline portion and the decline portion of the second channel section is curved and has a third radius of curvature.

6. The waveform water-transport channel of claim 5, wherein the first and third radii of curvature are smaller than the second radius of curvature.

7. The waveform water-transport channel of claim 1, further including a third channel section configured to transport water a third distance with respect to the horizontal plane, wherein a maximum separation between the third channel section and the reference plane is a third height, smaller than the second height, an incline portion of the third channel section is configured to rise at a fifth angle, smaller than the first angle, with respect to the reference plane, and a decline portion of the third channel section is configured to fall at a sixth angle with respect to the reference plane.

8. The waveform water-transport channel of claim 7, wherein the second, fourth, and sixth angles are equal to the first angle, and the fifth angle is equal to the third angle.

9. The waveform water-transport channel of claim 8, wherein the first angle is between thirty and fifty degrees with respect to the reference plane and the third angle is between twenty-five and forty-five degrees with respect to the reference plane.

10. The waveform water-transport channel of claim 7, wherein a first transition section between the incline portion and the decline portion of the first channel section is curved and has a first radius of curvature, a second transition section between the decline portion of the first channel section and the incline portion of the second channel section is curved and has a second radius of curvature, a third transition section between the incline portion and the decline portion of the second channel section is curved and has a third radius of curvature, a fourth transition section between the decline portion of the second channel section and the incline portion of the third channel section is curved and has a fourth radius of curvature, a fifth transition section between the incline portion and the decline portion of the third channel section is curved and has a fifth radius of curvature.

11. The waveform water-transport channel of claim 10, wherein the first, third, and fifth radii of curvature are smaller than the second or fourth radii of curvature.

12. The waveform water-transport channel of claim 1, wherein a cross-section of the channel is a rectangle, a dimension of the cross-section parallel to the reference plane is longer than a dimension of the cross-section not parallel to the reference plane.

13. The waveform water-transport channel of claim 1, wherein the first height of the first channel section is between fifteen and twenty-five meters, and the second height of the second channel section is between ten and twenty meters.

14. The waveform water-transport channel of claim 1, wherein the first and third radii of curvature are between one and five meters, and the second radius of curvature is between five and ten meters.

15. The waveform water-transport channel of claim 1, wherein an interior of the channel is coated with polytetrafluoroethylene (PTFE).

16. A system comprising:

a first water reservoir containing a first volume of water;

an oared pump with an output port, wherein the oared pump is partially submerged in the first volume of water and the output port is disposed at a top of the pump and wherein the oared pump comprises a cylindrical body and a plurality of radial oars fixedly coupled to the cylindrical body;

an incline, waveform water-transport channel, wherein an inlet port of the incline channel is coupled to the output port of the oared pump and an outlet port of the incline channel is disposed higher than the inlet port;

a second water reservoir coupled to the outlet port of the incline channel, and configured to contain a second volume of water;

a decline water-transport channel, wherein an inlet port of the decline channel is coupled to the second water reservoir and an outlet port of the decline channel is coupled to an electromotor and to the first water reservoir; and the electromotor configured such that a rotor of the electromotor is caused to rotate by a flow of water through the decline channel.

17. The system of claim 16, further comprising a first router that is shaped to facilitate the flow of water out of the first water reservoir and out of the output port of the oared pump when the cylindrical body rotates, the first router comprising a first portion disposed in the first volume of water and a second portion disposed outside of the first volume of water and wherein the first router does not come into physical contact with the plurality of radial oars.

18. The system of claim 17, further comprising a second router that is shaped to facilitate a flow of water out of the first water reservoir and out of the output port of the oared pump when the cylindrical body rotates, the second router comprising at least a first portion, a second portion, and a third portion, wherein:

the first portion of the second router extends around a first number of the plurality of radial oars and is located between the first number of the plurality of radial oars and the third portion of the second router and between a first wall of the output port and the second portion of the second router;

the second portion of the second router extends along a second number of the plurality radial oars and is located between the first router and the second number of the plurality of radial oars and adjacent to the first portion of the second router and the third portion of the second router; and the third portion of the second router extends into the output port, is located between the first wall and a second wall of the output port and adjacent to the second portion of the second router, and is configured to move within the output port in order to controllably restrict the flow of water as the flow of water moves through the output port;

the second router does not come into physical contact with the plurality of radial oars; and a path of the flow of water is located between the plurality of radial oars and the first router, between the first router and the second portion of the second router, and between the third portion of the second router and the second wall of the output port.

19. The system of claim 18, wherein the third portion of the second router is configured to move within the output port to restrict the flow of water through the output port during an initialization of the flow of water.

20. The system of claim 16, further comprising a water temperature control system that maintains water in the system between two and six degrees Celsius.

21. The system of claim 16, wherein a flow rate capacity through the incline channel is between 2,000 and 3,000 cubic meters per second.

* * * * *